US009084909B1

(12) United States Patent
Henley

(10) Patent No.: US 9,084,909 B1
(45) Date of Patent: Jul. 21, 2015

(54) APPARATUS AND METHOD FOR EXERCISE BALL CRADLE

(76) Inventor: Stephen D. Henley, Tomball, TX (US)

( * ) Notice: Subject to any disclaimer, the term of this patent is extended or adjusted under 35 U.S.C. 154(b) by 219 days.

(21) Appl. No.: 13/358,681

(22) Filed: Jan. 26, 2012

Related U.S. Application Data

(60) Provisional application No. 61/436,209, filed on Jan. 26, 2011.

(51) Int. Cl.

| | |
|---|---|
| ***A63B 21/00*** | (2006.01) |
| ***A63B 23/02*** | (2006.01) |
| ***A63B 21/008*** | (2006.01) |
| *A63B 23/00* | (2006.01) |

(52) U.S. Cl.
CPC ..... *A63B 21/00047* (2013.01); *A63B 21/0087* (2013.01); *A63B 21/00109* (2013.01); *A63B 21/1457* (2013.01); *A63B 21/1476* (2013.01); *A63B 23/02* (2013.01); *A63B 21/00185* (2013.01); *A63B 23/0205* (2013.01); *A63B 23/0216* (2013.01); *A63B 23/0233* (2013.01); *A63B 23/0238* (2013.01); *A63B 2023/006* (2013.01)

(58) Field of Classification Search
CPC ..... A63B 22/16; A63B 22/18; A63B 22/20; A63B 22/201; A63B 22/203; A63B 21/0047; A63B 21/0087; A63B 21/00109; A63B 21/00185; A63B 21/1457; A63B 21/1465; A63B 21/1476; A63B 2023/006; A63B 23/02; A63B 23/0205; A63B 23/0216; A63B 23/0233; A63B 23/0238; A63B 26/003; A63B 2208/0252; Y10S 482/907; A47C 9/002; A61G 13/009; A61H 1/02; A61H 1/0292; A61H 2203/0456; A47D 9/00
USPC ..... 482/131, 132, 140, 142
See application file for complete search history.

(56) References Cited

U.S. PATENT DOCUMENTS

| | | | | | |
|---|---|---|---|---|---|
| 138,598 | A | * | 5/1873 | Winecoff | 297/314 |
| 2,209,034 | A | * | 7/1940 | Paul | 482/57 |
| 3,544,103 | A | * | 12/1970 | Conable | 482/130 |
| 4,198,045 | A | * | 4/1980 | Miller | 482/130 |
| 4,307,880 | A | * | 12/1981 | Abram | 482/142 |
| 4,341,378 | A | * | 7/1982 | Agyagos | 482/142 |
| 4,352,491 | A | * | 10/1982 | Bellia | 482/142 |
| 4,568,079 | A | * | 2/1986 | Stark | 472/14 |
| 4,638,995 | A | * | 1/1987 | Wilson | 482/142 |
| 4,666,153 | A | * | 5/1987 | Soble | 482/142 |
| 5,348,523 | A | * | 9/1994 | Blount | 482/104 |
| 5,411,458 | A | * | 5/1995 | Giust | 482/101 |
| 5,462,509 | A | * | 10/1995 | Lister | 482/132 |
| 5,702,354 | A | * | 12/1997 | DeSpain et al. | 601/27 |
| 6,063,015 | A | * | 5/2000 | Johnston | 482/142 |

(Continued)

*Primary Examiner* — Loan H Thanh
*Assistant Examiner* — Sundhara Ganesan
(74) *Attorney, Agent, or Firm* — Buskop Law Group, PC; Wendy Buskop

(57) ABSTRACT

An cradle to support a person or an exercise ball provides an upwardly-facing, elongated concave working surface to restrict lateral movement of an exercise ball during exercise. The device permits an exercise ball to be rolled along the longitudinal axis of the cradle while providing a user with a handrail, foot restraints, and a headrest. An optional support assembly may be provided to elevate the cradle; to facilitate inclining the cradle; or to permit sliding of the cradle. The user is able to generate body toning, and strengthening by keeping the foot, or feet, or hands in a fixed location on the device while the user's body is supported by the compressible support component.

19 Claims, 8 Drawing Sheets

(56) References Cited

U.S. PATENT DOCUMENTS

| | | | | |
|---|---|---|---|---|
| 6,238,322 | B1 * | 5/2001 | Hsu | 482/96 |
| 6,245,000 | B1 * | 6/2001 | Saakian et al. | 482/142 |
| 6,375,601 | B1 * | 4/2002 | Johnson | 482/142 |
| 6,461,284 | B1 | 10/2002 | Francavila | |
| 6,478,721 | B1 * | 11/2002 | Hunter | 482/140 |
| 6,547,706 | B1 * | 4/2003 | Chek | 482/148 |
| D476,705 | S * | 7/2003 | Dillard | D21/662 |
| 6,666,802 | B1 * | 12/2003 | Rasmussen | 482/148 |
| 6,669,611 | B2 * | 12/2003 | Raymond | 482/148 |
| 6,699,162 | B2 * | 3/2004 | Chen | 482/140 |
| 6,730,005 | B1 * | 5/2004 | Liao | 482/142 |
| 6,746,372 | B2 * | 6/2004 | Hsu | 482/34 |
| 7,044,558 | B2 | 5/2006 | Chiu | |
| 7,169,096 | B1 * | 1/2007 | Vittone et al. | 482/140 |
| 7,476,189 | B2 | 1/2009 | Hale | |
| 7,575,540 | B1 | 8/2009 | Dobrow | |
| 7,674,216 | B1 * | 3/2010 | Bolling | 482/142 |
| 7,819,781 | B1 * | 10/2010 | Maldonado | 482/62 |
| D634,375 | S * | 3/2011 | Usrey | D21/662 |
| 7,901,339 | B2 * | 3/2011 | Schechter | 482/142 |
| 7,993,250 | B2 * | 8/2011 | Abbott | 482/93 |
| 8,313,420 | B2 * | 11/2012 | Casha | 482/131 |
| 8,425,383 | B1 * | 4/2013 | Kelly | 482/13 |
| 2002/0132710 | A1 * | 9/2002 | Jacobsen | 482/123 |
| 2004/0180768 | A1 * | 9/2004 | Almada | 482/142 |
| 2005/0079964 | A1 * | 4/2005 | Francavilla | 482/142 |
| 2005/0250630 | A1 * | 11/2005 | Webb | 482/142 |
| 2005/0277523 | A1 * | 12/2005 | Harbaugh et al. | 482/92 |
| 2006/0035769 | A1 * | 2/2006 | Phillips | 482/123 |
| 2006/0105894 | A1 * | 5/2006 | Denoth et al. | 482/142 |
| 2008/0176727 | A1 * | 7/2008 | Heitzman | 482/142 |
| 2009/0325770 | A1 * | 12/2009 | Baschnagel | 482/142 |
| 2011/0207587 | A1 * | 8/2011 | De La Rambelje | 482/140 |

* cited by examiner

APPARATUS AND METHOD FOR EXERCISE BALL CRADLE

RELATED APPLICATIONS

This application is related to U.S. Provisional Patent Application No. 61/436,209 filed on Jan. 26, 2011, and claims the priority of the application.

BACKGROUND OF THE INVENTION

1. Field of Invention

This application relates to a device and method for an exercise cradle, where the cradle supports a person or an exercise ball.

2. Prior Art

The prior art includes several approaches to containing or supporting an exercise ball. U.S. Pat. No. 7,575,540 for an exercise ball riser describes a riser in combination with a semispherical ball having a rigid base plate of a given diameter, the riser elevates the ball. The riser includes a portion extending in a longitudinal direction of the riser. The portion has an outside diameter and an inside diameter dimensioned for receiving the given diameter of the rigid base plate. A further portion is adjacent the portion and extends in the longitudinal direction of the riser. The further portion has a further inside diameter. The further inside diameter is smaller than the inside diameter thereby defining a shoulder there between. The shoulder is configured for supporting the base plate.

U.S. Pat. No. 7,476,189 for a foldable exercise machine describes an exercise device which includes a deflatable spherical exercise ball mounted on a frame for rotation above a support surface that supports the frame so that the ball rotates freely without interference from the support surface. The frame is foldable so that when the ball is deflated, the frame may be stored in a space substantially smaller than the space occupied by the exercise device when in a fully deployed configuration. A first pair of inclined tubes is pivotally connected to one another at their respective upper ends so that they collectively form an inverted "V" shape when the device is fully deployed. A second pair of inclined tubes is transversely opposed to the first pair of inclined tubes. A forward base includes foot restraints. The first and second pairs of inclined tubes are coplanar with the forward base when the device is folded.

U.S. Pat. No. 7,044,558 for a ball chair with a retaining device describes a ball chair with a retaining device having a seat (10), a spherical cushion (20) and two retaining pieces. The spherical cushion (20) rests on the seat (10). The two retaining pieces are selective retaining rods or retaining walls and are respectively attached to a rear end and a front end of the seat (10). Thus, the spherical cushion (20) is held between the two retaining pieces and firmly secured on the seat (10) to keep the spherical cushion (20) from falling off the ball chair.

U.S. Pat. No. 6,461,284 describes an exercise apparatus with a base having a concave recess in its top surface adapted to receive a resilient ball and at least one attachment point for removal attaching an elastic band. The elastic band has a handhold attached to its end that can be grasped by a user to perform a desired exercise regimen.

The current invention provides an improved cradle support device for an exercise ball or a user.

BRIEF SUMMARY OF THE INVENTION

The current invention provides a cradle support device for an exercise ball or for a person. In one embodiment, the device permits an exercise ball to be rolled along the longitudinal axis of the cradle while providing a user with a handrail, foot restraints, and a headrest.

In another embodiment of the current invention, the user may be supported in the cradle without the use of an exercise ball.

In another embodiment of the current invention, the cradle may slide along support rails.

In another embodiment of the current invention, the cradle may be inclined to a desired angle to decrease resistance.

In another embodiment, the cradle may be supported on an elevated platform.

The current invention provides a body toning and strengthening apparatus which may be used to enhance multiple areas of the human body. This apparatus is made to sustain the user by the use of any type of: compressible spherical (such as an exercise ball), elliptical, or radial shaped, or flat load bearing component. Such components are supported by a concave platform assembly, a "cradle", which may be used as a standalone device, or mounted to a support subassembly which is typically placed on a stable grade. Examples of a support subassembly include, but are not limited to, a fixed frame; a pivoting frame; a frame which supports a sliding cradle; and an elevated support. The concave platform assembly is mounted in an axial direction with the support subassembly, and parallel to the grade which it rests upon.

When an exercise ball, or other compressible support component is placed in this apparatus, the compressible support component's motion of travel is limited primarily to the Z axis, longitudinal with respect to the cradle, with nominal controlled travel (side-to-side motion) in the X axis. The vertical Y axis is utilized to insert or extract the compressible support component. When the user has mounted the apparatus, stability is established by the concave shape of the upper apparatus platform assembly. The apparatus can be mounted in the seated, supine, or the prone position. In some embodiments, universal foot restraint systems are located on the ends of the secondary subassembly to position the feet parallel to the floor and in an axial relationship to the lower subassembly. A hand grip feature is provided at one or both ends to support the user when user is in the prone mounted position allowing the user's lower torso to extend unsupported past the compressible support component which is restrained in the concave platform subassembly. The user is able to generate body toning, and strengthening by keeping the foot, or feet or hands in a fixed location on the apparatus in conjunction while the user's body is supported by the compressible support component.

DESCRIPTION OF EMBODIMENT

Fitness Cradle Device and Fixed Support Subassembly

Figure 1:
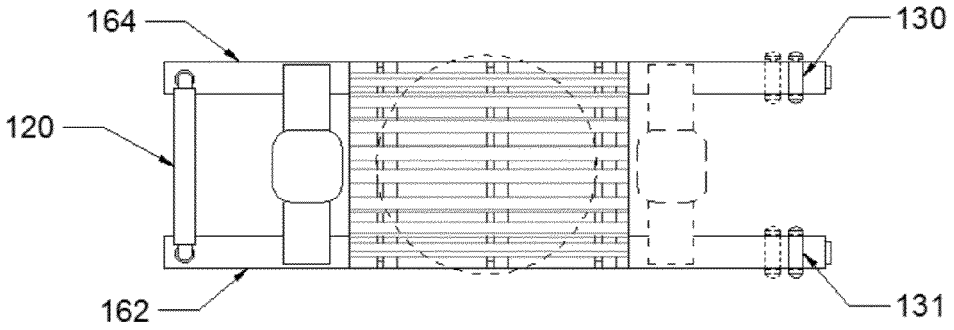
FIG. 1 is a top view of one fitness cradle device embodiment of the current invention.
Figure 2:
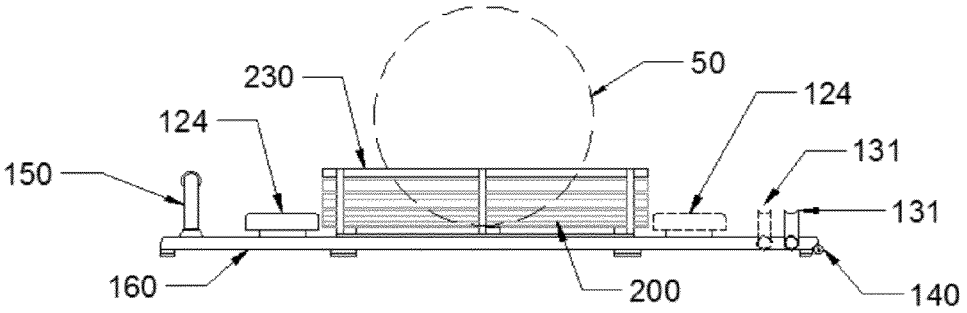
FIG. 2 is a side view of the fitness cradle of FIG. 1.
Figure 3:
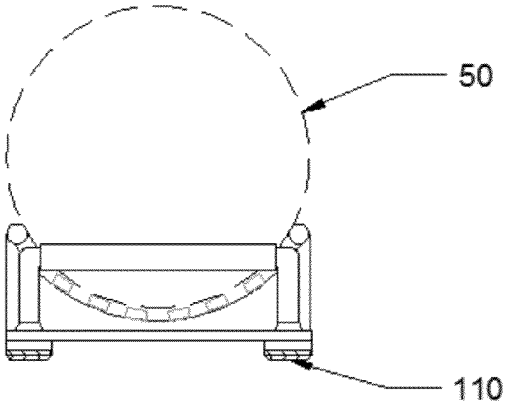
FIG. 3 is a front view of the fitness cradle of FIG. 1.
Figure 5:
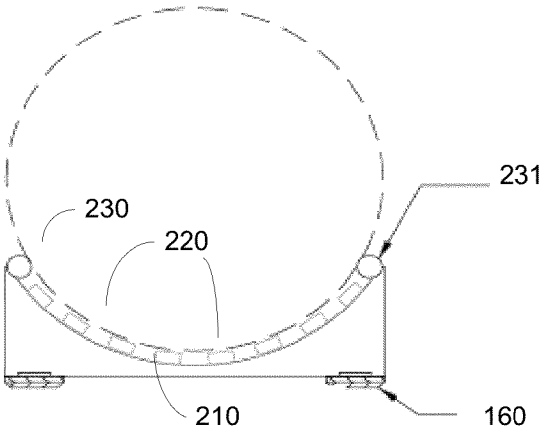
FIG. 5 is a front view of the detached cradle of FIG. 4.
Figure 4:
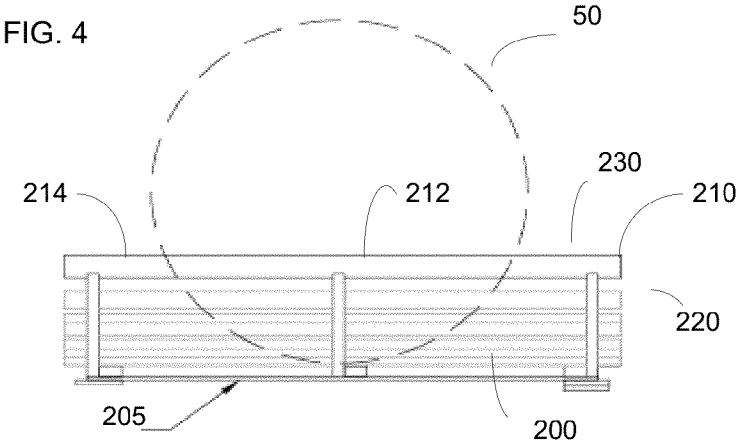
FIG. 4 is a side view of cradle portion detached from the device of FIG. 1.
Figure 6:
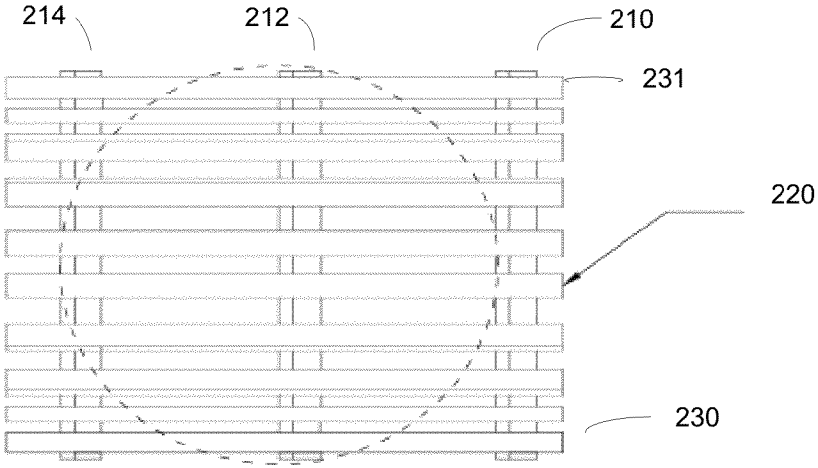
FIG. 6 is a top view of the detach cradle of FIG. 4.

Referring to FIGS. 1-3, which are views of an example fitness cradle embodiment of the current invention, the example device includes a lower frame 160 which supports a cradle 200. In this example, the lower frame 160 includes a pair of spaced-apart bottom support members 162 and 164; and protective feet 110. A handgrip element 120 is provided at one end of the bottom support members, and foot restraints 130 and 131 are provided on the other end of the bottom support members. Rollers 140 are provided on the support members on the opposite side as the handle, to permit the device to be rolled to a desired location.

The cradle is typically formed of rigid materials that allow for flexure deforming during the transfer of weight from the user while engaging the apparatus to exercise. The cradle provides a concave user or exercise ball support. The cradle may be used separately as a stand-alone device or in conjunction with a support subassembly. The cradle can have a number of slats, rails, or the like that may be equally spaced from one another but parallel to each other. Such rails, slats or the like may be fastened with non-metallic or metallic fasteners to a number of vertical supports places beneath at a distance from one another but perpendicular to the rails, slats or the like. Said rails, slats or the like may have a surface finish condition as such to create a desired amount of friction.

Figure 15:
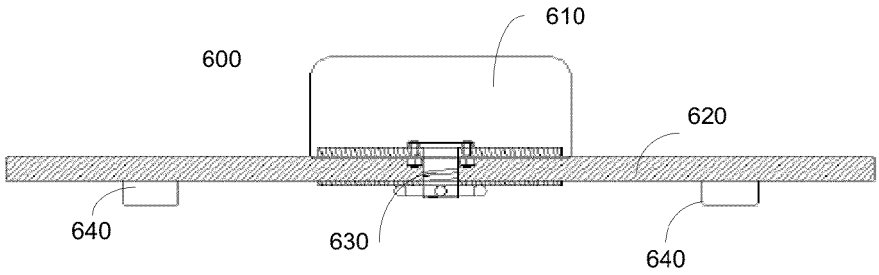
FIG. 15 is an exploded side view of an example headrest assembly.
Figure 16:
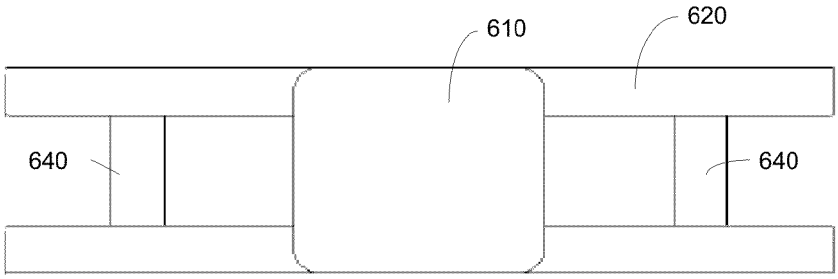
FIG. 16 is a top view of the headrest assembly of FIG. 15.

In one example, a removable headrest can be placed on either end of the cradle. FIG. 15 is an exploded side view of an example headrest assembly. In this example, the headrest assembly 600, includes a headrest cushion 610 which is bolted to a headrest assembly base 620 with mounting bolt 630. The base includes headrest assembly guides 640. FIG. 16 is a top view of the headrest assembly of FIG. 15. The base may slide adjustably with respect to the lower frame. In other examples, the headrest may be attached to the cradle or frame.

The location of the foot restraints can be selected along two or more points of the support members in order to accommodate different heights of users. As described in more detail below, one example of use of the fitness cradle is to support an exercise ball 50 as shown in FIG. 2. An exercise ball is typically constrained within the upwardly-facing concave working surface of the cradle portion of the device, so that an exercise ball is rolled back and forth longitudinally along the cradle.

The slat supports are typically arced to provide the concave shape, and may have a mounting plate fixed to the face side of each vertical support in order to connect the cradle to a support subassembly such as the lower frame.

The rails, slats or the like are fixed to such supports in such an arrangement to form a concave, upwardly facing radius, running in an axial direction. This shape establishes a controlled motion of travel in the Z axis such as when an exercise ball is positioned in the cradle to support the user's body weight.

In this example, at the highest point of each vertical support, a rigid side rail is typically provided. In this example, the side rails are elongated cylinder mounted opposite one another, similar in length to the combined total spacing of the vertical supports. This feature provides support for a user when mounting, and or dismounting the apparatus, as well as a gripping element for various exercises with or without an exercise ball.

This combination of assembled components is identified as the cradle.

Adjustable mounts may be fixed to the underside of the said primary assembly to serve as base plates when placed on a stable substrate or used as a stand-alone apparatus for body toning.

In another example, the cradle may have a fixed number of rigid rails in an axial relationship, to function as additional stabilizers. Such stabilizers could have an easy or quick release action for attaching and detaching of the primary assembly. The rails may include additional features such as, but not limited to, a foot or feet restraint system, hand rails, hand pulls, suspended pulls, grips or any other type of feature allowing the user to engage a hand or foot in order to establish stability or leverage. The rails may be fitted with guide rails mounted to the top surface, located in such manner to permit the user to temporarily change the orientation of the primary assembly. A plurality of riser components may be provided on the underside of the rails in order to provide ground clearance between the rails and the stable plane which supports the assembly. The risers may have a modified surface or a surface material or condition applied, which may create a type of friction, to limit the motion of the apparatus while in use. One or both ends of the rails may include roller or slide features that permit the apparatus to be transported by lifting one end while allowing the opposite end to remain in constant contact with the surface plane. The surface of any or all apparatus components may have a natural, or manmade finish.

DESCRIPTION OF EMBODIMENT

Fitness Cradle Device with Raised Platform Support

Figure 13:
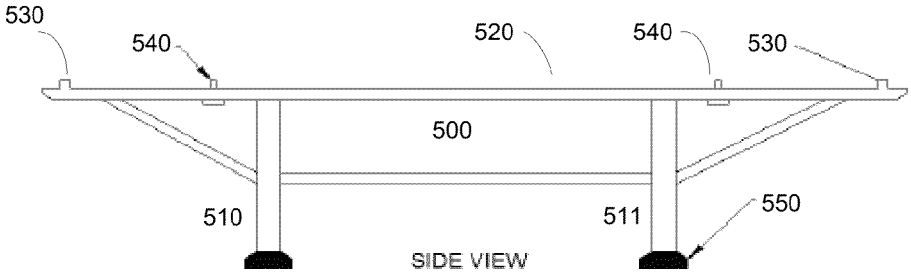
FIG. 13 is a side view of a mounting stand for elevating the cradle.
Figure 14:
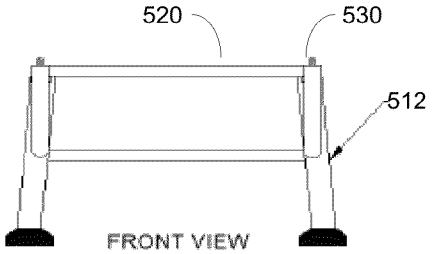
FIG. 14 is a front view of the mounting stand of FIG. 13.

In this embodiment, the support assembly may be used to raise the cradle. FIGS. 13 and 14 show an example mounting stand for elevating the cradle. In this example, a support platform 500 includes legs 510, 511, 512, 513 with stabilizers 550,0 and top support 520. The top surface 520 may include locating pins 530 or other alignment features to properly orient the cradle with respect to the support platform. Clamping elements 540 may be provided to permit the cradle to be attached to and detached from the support platform.

DESCRIPTION OF EMBODIMENT

Fitness Cradle Device without Support Subassembly

Referring to FIGS. 4-7, which are detailed views of an embodiment of the cradle detached from the support frame, the cradle includes a first side rail 230 a second side rail 231 supported with risers above a cradle base 205, arced frame members 210, 212, and 214, and a plurality of longitudinal slats 220. The cradle may have additional frame members and detachable feet 160.

In the figures shown, a plurality of longitudinal slats are oriented to form a concave working surface for directly supporting a user, or for supporting an exercise ball or other exercise aid. In other examples, the concave working surface may be a solid surface or other configuration. In these examples, it is possible to provide a concave working surface without requiring the arced frame members shown in the figures. In the case where the concave working surface is molded or extruded, such as from a plastic material, the side rails may be provided as an integral feature of the concave working surface.

In this example, the arced frame members are formed by a vertically oriented ¾ inch plywood or composite material with a top edge cut to the arc shape. In this example, the cradle base is formed by the bottom edges of the arced frame members, and the bottom edges may be reinforced with lateral frame members. In other examples, a combination of risers and curved support elements may be used to support slats.

A carrying case or bag may be provided to facilitate transport of the cradle, such as by a physical therapist. The cradle my be transported intact or by partial disassembly or folding.

DESCRIPTION OF EMBODIMENT

Cradle Device with Exercise Ball

Referring to FIGS. 1-3, in this embodiment a single exercise ball 50 is introduced to the fitness cradle. The ball is retained in the cradle by the concave design of the cradle. The ball can be manually positioned by rolling it backwards or forwards while supported within the cradle. The surface condition of the interior of the cradle 220 will resist ball slippage, and provide a useful working friction to maintain ball location so that the ball may be rolled in the axial direction when desired, and otherwise resist unintended rolling.

With the ball in place the user can mount the ball in the prone position. By grabbing a hand grip 150, the user is able to extend the lower body upward to generate resistance. User may also mount the ball while secured in the cradle in the seating position. By means of inserting one or both feet into a foot restraint device 131, the user is able to extend the upper torso in a downward direction generating mid-body resistance. Existing fitness apparatus may be used in conjunction with device, while the ball is securely supported in the cradle. It is recommended that the apparatus be supported upon a level surface.

DESCRIPTION OF EMBODIMENT

Cradle Device without Exercise Ball

Referring to FIGS. 1-3, in this embodiment, by placing a flat compressible component (such as an exercise mat) in the cradle 220 the user is able to mount in the supine position, placing the head on the headrest 124. In other examples, the user may sit or lie directly in the cradle without a mat. By means of grabbing a hand grip 150 the user is able to lift the lower portion of the body in an upward action, creating mid-body resistance. By means of inserting one or both feet into the foot restraint device 131, the user is able to extend the upper torso in an upward direction generating mid-body resistance. For ease of mounting and dismounting, the side rails 230 provide the user a means of leverage.

Example exercises without exercise ball include sit-ups with feet in foot restraints lying in cradle; inclined push ups with feet on floor while grasping side rails with hands; and various leg raises while lying in the cradle and grasping the handbar.

DESCRIPTION OF EMBODIMENT

Sliding Cradle Device

Figure 7:
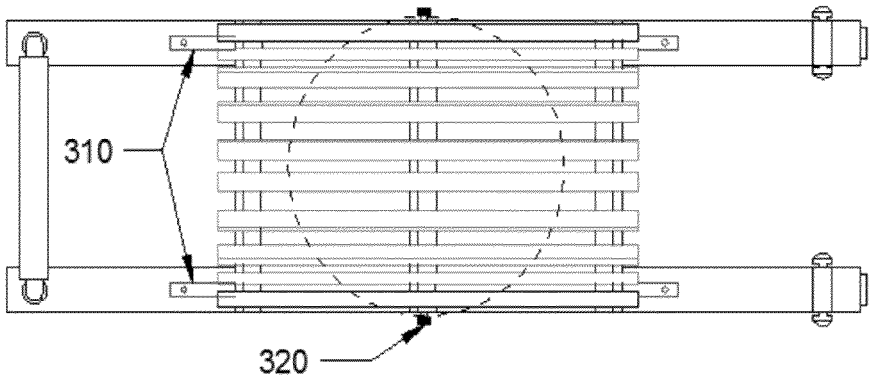
FIG. 7 is a top view of a sliding cradle embodiment of the current invention.
Figure 9:
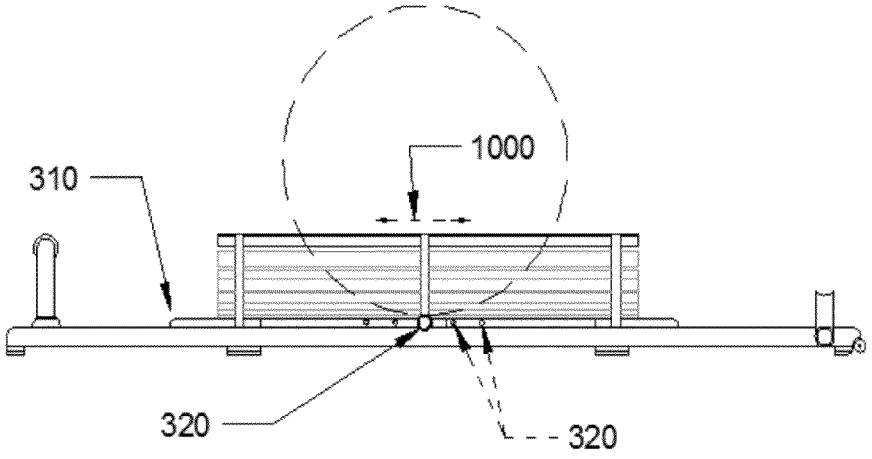
FIG. 9 is a side view of the sliding cradle embodiment of FIG. 7.
Figure 8:
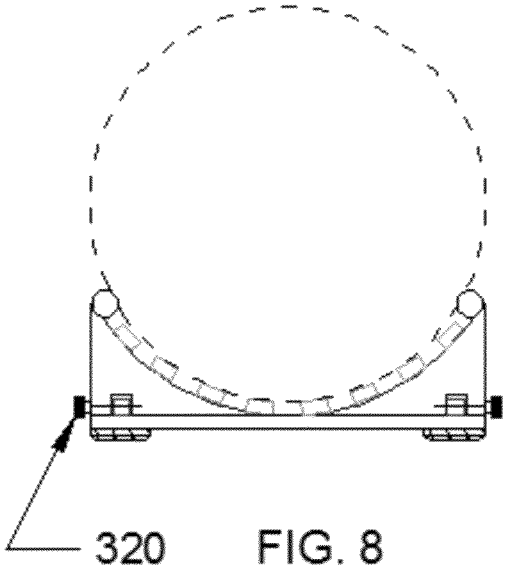
FIG. 8 is a front view of the sliding cradle embodiment FIG. 7.

Referring to FIGS. 7-9, in this embodiment a slide guide 310 is provided on each support member, and the cradle slides along the slide guide. A desired slide resistance may be selected with two slide adjustment controls 320 provided on the cradle.

DESCRIPTION OF EMBODIMENT

Tilting Cradle Device

Figure 10:
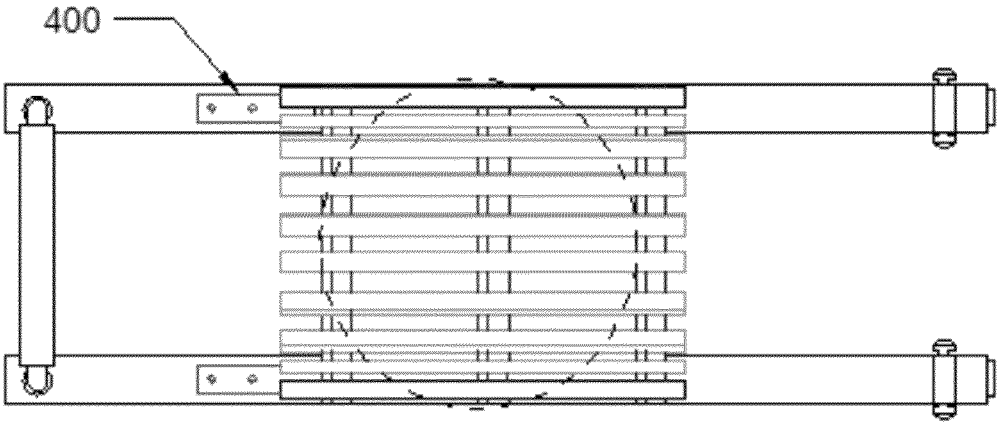
FIG. 10 is a top view of a tilting cradle embodiment of the current invention
Figure 12:
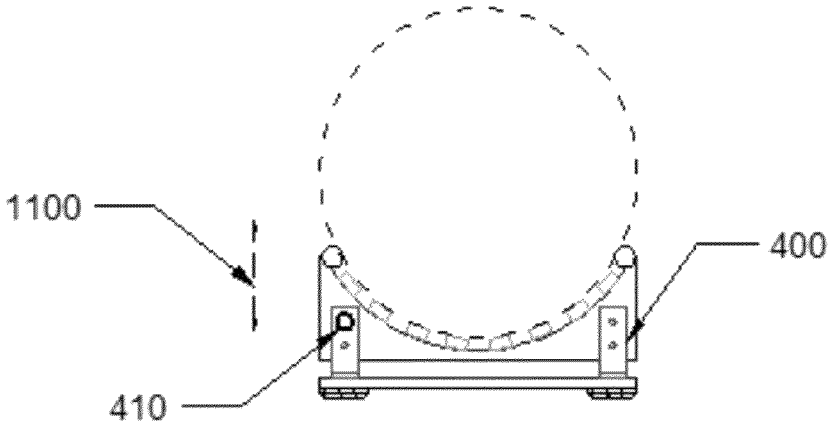
FIG. 12 is a front view of the tilting cradle embodiment of FIG. 10.
Figure 11:
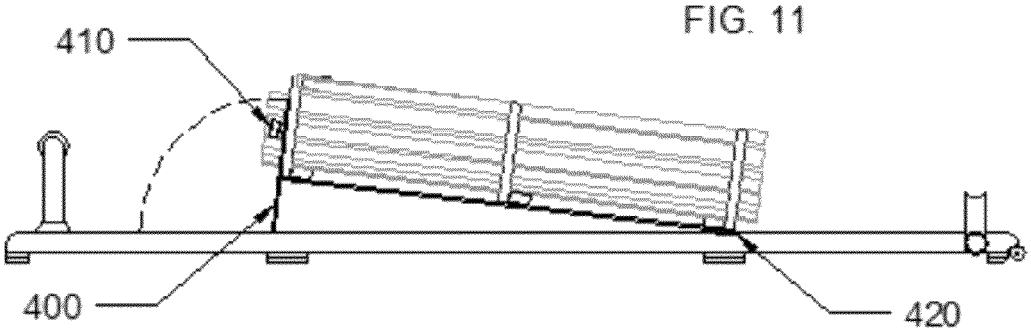
FIG. 11 is a side view of the tilting cradle embodiment of FIG. 10.

Referring to FIGS. 10-12, in this embodiment one end of the cradle includes a pivot 420, and the opposite end of the cradle includes a height adjustment control 410. The height adjustment control permits the elevation of the cradle to be selected to form an incline for the cradle to provide a desired resistance for exercises as described below.

The primary assembly may have a fixed pivotal feature mounted on one or both ends, to permit vertical height adjustments to one end, or the other. These features permit the user to increase or decrease the amount of resistance experienced while lifting the upper or lower torso.

The scope of the current invention is not limited to the specific embodiments and examples described above, and variations will be apparent to those skilled in the art.

What is claimed is:

1. A fitness cradle exercise device comprising
a base;
a first side rail;
a second side rail spaced-apart from the first side rail, wherein the second side rail is substantially parallel to the first side rail;
a cradle comprising a plurality of longitudinal slats, wherein each of the plurality of longitudinal slats traverses an orientation of a plurality of arced frame members, wherein each arced frame member is substantially parallel to each other arced frame member, each arced frame member is attached to the first side rail and the second side rail, and each arced frame member is oriented to define at least a portion of a concave cavity wherein the concave cavity is curved like a segment of the interior of a circle forming an elongated concave working surface created between (i) the plurality of arced frame members, and (ii) the first side rail and the second side rail comprising the concave cavity, wherein the longitudinal slats are aligned along arcs of the arced frame members.

2. The cradle exercise device of claim 1 further comprising a cradle support assembly.

3. The cradle exercise device of claim 2 further comprising a sliding mechanism, such that the cradle may slide relative to the cradle support assembly.

4. The cradle exercise device of claim 1 further comprising a tilting mechanism, such that the cradle may be positioned at an angle relative to a floor or other support surface.

5. The cradle exercise device of claim 1 further comprising a handrail.

6. The cradle exercise device of claim 1 further comprising a headrest.

7. The cradle exercise device of claim 1 further comprising a pair of foot restraints.

8. An exercise system comprising
an exercise ball; and
a fitness cradle assembly comprising a frame having a longitudinal axis, and an upwardly facing concave cradle of a plurality of longitudinal slats, wherein each of the plurality of longitudinal slats traverses an orientation of a plurality of arced frame members, each of the longitudinal slats having a longitudinal axis along the frame longitudinal axis, wherein the upwardly facing concave cradle comprises a pair of substantially parallel rails attached transversed to a plurality of arced frame members, wherein each arced frame member is substantially parallel to each other arced frame member used, each arced frame member is attached to a first side rail and a second side rail, and each arced frame member is oriented to define at least a portion of a concave cavity wherein the concave cavity is curved like a segment of the interior of a circle forming an elongated concave working surface created between (i) the plurality of arced frame members, and (ii) the first side rail and the second side rail comprising the concave cavity, wherein the longitudinal slats are aligned along arcs of the arced frame members.

9. The exercise system of claim 8 further comprising a sliding mechanism, such that the upwardly facing concave cradle may slide relative to the frame.

10. The exercise system of claim 8 further comprising a tilting mechanism, such that the upwardly facing concave cradle may be positioned at an angle relative to the frame.

11. The exercise system of claim 8 further comprising a handrail;

an adjustable headrest; and a pair of foot restraints.

12. The exercise system of claim 8 further comprising a cradle support assembly.

13. A method of exercising comprising providing an exercise cradle assembly comprising a frame having a longitudinal axis, and an upwardly facing concave cradle comprising a plurality of longitudinal slats having a longitudinal axis along the frame longitudinal axis, wherein each of the plurality of longitudinal slats traverses an orientation of a plurality of arced frame members, wherein the upwardly facing concave cradle comprises a pair of substantially parallel rails attached traversed to a plurality of arced frame members, wherein each arced frame member is substantially parallel to each other arced frame member, each arced frame member is attached to a first side rail and a second side rail, and each arced frame member is oriented to define at least a portion of a concave cavity forming an elongated concave working surface created between (i) the plurality of arced frame members, and (ii) the first side rail and the second side rail comprising the concave cavity, wherein the longitudinal slats are aligned along arcs of the arced frame members;

providing an exercise ball;

placing the exercise ball in the upwardly facing concave cradle; and performing exercises while the exercise ball is contained within the cradle.

14. The method of exercising of claim 13 further comprising rolling the exercise ball along the longitudinal axis of the cradle.

15. The method of exercising of claim 13 further comprising providing a sliding mechanism on the exercise cradle assembly; and sliding the upwardly facing concave cradle relative to the frame.

16. The method of exercising of claim 13 further comprising providing a tilting mechanism on the exercise cradle assembly;

setting the upwardly facing concave cradle at a tilt relative to the frame; and performing exercises while the exercise ball is contained within the upwardly facing concave cradle.

17. The method of exercising of claim 13 further comprising providing a hand rail on the exercise cradle assembly.

18. The method of exercising of claim 13 further comprising providing at least one foot restraint on the exercise cradle assembly.

19. The method of exercising of claim 13 further comprising providing a head rest on the exercise cradle assembly.

* * * * *